US007560666B2

(12) United States Patent
Ando

(10) Patent No.: US 7,560,666 B2
(45) Date of Patent: Jul. 14, 2009

(54) GLOW PLUG AND METHOD OF PRODUCING THE SAME

(75) Inventor: Ikuya Ando, Kariya (JP)

(73) Assignee: Denso Corporation, Kariya (JP)

( * ) Notice: Subject to any disclaimer, the term of this patent is extended or adjusted under 35 U.S.C. 154(b) by 784 days.

(21) Appl. No.: 10/988,695

(22) Filed: Nov. 16, 2004

(65) Prior Publication Data

US 2005/0104496 A1 May 19, 2005

(30) Foreign Application Priority Data

Nov. 17, 2003 (JP) ..... 2003-386249

(51) Int. Cl.
*F23Q 7/22* (2006.01)
*F23Q 7/00* (2006.01)

(52) U.S. Cl. ..... 219/270; 219/260

(58) Field of Classification Search ..... 219/270, 219/260, 261, 262, 263, 264, 265, 266, 267, 219/268, 269
See application file for complete search history.

(56) References Cited

U.S. PATENT DOCUMENTS

| | | | | |
|---|---|---|---|---|
| 2002/0130121 | A1* | 9/2002 | Taniguchi et al. | 219/270 |
| 2002/0153365 | A1* | 10/2002 | Taniguchi et al. | 219/270 |
| 2002/0163286 | A1* | 11/2002 | Nasu et al. | 313/143 |
| 2003/0080103 | A1* | 5/2003 | Hamel et al. | 219/270 |
| 2004/0124754 | A1* | 7/2004 | Yoshikawa et al. | 313/118 |

FOREIGN PATENT DOCUMENTS

| | | |
|---|---|---|
| FR | 2830924 | 10/2002 |
| JP | A-S58-168819 | 10/1983 |
| JP | A-S63-025416 | 2/1988 |
| JP | 63-251724 A | 10/1988 |
| JP | A-H01-054121 | 3/1989 |
| JP | 3-13485 | 2/1991 |
| JP | 2002-303424 A | 10/2002 |
| JP | 2003-56849 | 2/2003 |
| JP | 2003-166715 | 6/2003 |

OTHER PUBLICATIONS

Examination Report mailed Nov. 20, 2007 in JP Application No. 2003-386249 with English translation.
French Office Action dated Jan. 31, 2007.
Japanese Office Action mailed Aug. 7, 2007 in Application No. 2003-386249 with English translation.

* cited by examiner

*Primary Examiner*—Daniel L Robinson
(74) *Attorney, Agent, or Firm*—Nixon & Vanderhye, PC

(57) ABSTRACT

A glow plug includes a sleeve secured by press-fitting to a housing with a ceramic heater held therein. A lead wire exposed from the heater is electrically connected to an inside surface of the sleeve to form a joint portion. The joint portion and a press-fit portion formed between the sleeve and the housing are offset in position relative to each other along an axial direction of the housing. The joint portion is thus kept free from the influence of a load or pressure applied during press-fitting operation to form the press-fit portion. A method of producing such glow plug is also disclosed.

9 Claims, 12 Drawing Sheets

GLOW PLUG AND METHOD OF PRODUCING THE SAME

CROSS REFERENCE TO RELATED APPLICATION

This application is based upon and claims the benefit of priority of the prior Japanese Patent Application No. 2003-386249 filed on Nov. 17, 2003 so that the description of which is incorporated herein by reference.

BACKGROUND OF THE INVENTION

1. Field of the Invention

The present invention relates to a glow plug having a ceramic heater held in a cylindrical sleeve press-fitted in a cylindrical housing, and a method of producing such a glow plug.

2. Description of the Related Art

Glow plugs, having a rod-like ceramic heater capable of generating heat when energized and a cylindrical sleeve press-fitted in a cylindrical housing with the ceramic heater held therein, are known heretofore as disclosed, for example, in Japanese Patent Publication (JP-B) No. 3-13485.

FIG. 15 hereof shows in longitudinal cross-section a part of a typical example of such known glow plugs.

As shown in FIG. 15, the known glow plug includes a cylindrical housing 110 in which a cylindrical sleeve 120 is press-fitted. The sleeve 120 has one end portion projecting from an end 111 of the housing 110 and the other end portion press-fitted in the housing 110. The other end portion of the sleeve 120 thus forms a press-fit portion 123 where the sleeve 120 and the housing 110 are secured together.

A rod-like ceramic heat generating member or heater 133 that can generate heat when energized or supplied with electricity is held in the sleeve 120 with one end portion 131 projecting from a projecting end 121 of the sleeve 120 and the other end portion thereof inserted in the sleeve 120.

The heater 130 includes a heater element 133 of electrically conductive ceramic buried in a ceramic insulator 135. Two lead elements 134 are connected to opposite ends of the heater element 133. One of the lead elements 134 has an end portion exposed to an outer peripheral surface of a portion of the insulator 135 that is located inside the sleeve 120.

The thus exposed end portion of the lead element 134 and an inside surface of the sleeve 120 are joined together by brazing for electric connection and form a joint portion 136 where the heater 130 and the sleeve 120 are electrically connected with each other.

In the manufacture of the glow plug, the rod-like ceramic heater 130 is inserted in the sleeve 120 in such a manner as described above, and the sleeve 120 is then press-fitted in the housing 110 in such a manner as described above with the heater 130 held in the sleeve 120.

In the known glow plug of the foregoing construction, the joint portion 136 is very weak or brittle at a heater side thereof because of the presence of a metal wire or a ceramic material of a different kind from the ceramic insulator 135 is buried as the lead element 134 in the ceramic insulator 135.

When the sleeve 120 is secured by press-fitting to the housing 110 with the heater 130 held therein, the joint portion 136 between the sleeve 120 and the heater 130 is subjected to a load or pressure (hereinafter referred to as "press-fitting load") as it overlaps with the press-fit portion 123.

Application of the press-fitting load to the joint portion 136 which is weak or brittle at the hater side thereof may result in the generation of micro-cracks, which will cause a conduction failure between the lead element 134 and the sleeve 120 or lower the operational reliability, in performing repeated energization of the heater element 133.

The sleeve 120 and the housing 110 may be secured together by brazing rather than by press fitting. In the brazing process, only a small load is applied to the joint portion 36 and, hence, the heater 130 has little fear of rupturing at the joint portion 136. The brazing process is, however, time-consuming, cost-ineffective as compared to the press-fitting process.

SUMMARY OF THE INVENTION

With the foregoing problems in view, it is an object of the present invention to provide a glow plug and a method of producing the same, wherein a sleeve is secured by press-fitting to a housing with a ceramic heater held in the sleeve such that a joint portion between the heater and the sleeve is kept free from the influence of a load or pressure applied during press-fitting operation of the sleeve relative to the housing.

To achieve the foregoing objects, according to a first aspect of the present invention, there is provided a glow plug comprising a cylindrical housing, a cylindrical sleeve having a front end portion projecting from an end of the housing and a rear end portion secured by press-fitting to the housing, and a ceramic heater of rod-like configuration held in the sleeve with a front end portion thereof projecting from a front end of the sleeve and a rear end portion thereof inserted in the sleeve. The ceramic heater is capable of generating heat when energized and includes an electrically conductive heat generating portion, an insulator of insulating ceramic in which the heat generating portion is buried, and a lead portion electrically connected to the heat generating portion and having an end portion exposed to an outer peripheral surface of the insulator inside the sleeve. The exposed end portion of the lead portion and an inside surface of the cylindrical sleeve are electrically connected together and jointly form a joint portion, and the sleeve has a press-fit portion where the sleeve is secured by press-fitting to the housing. The press-fit portion and the joint portion are offset in position relative to each other along an axis of the cylindrical housing.

By virtue of the axially offset positional relationship between the press-fit portion and the joint portion, the joint portion does not constitute a portion of the press-fit portion and hence is free from the effect of a load or pressure applied when the sleeve and the housing are secured together by press-fitting.

In brief, the glow plug of the present invention includes a ceramic heater held in a sleeve, which is secured by press-fitting to a housing. A joint portion where the heater and the sleeve are electrically connected is kept free from the influence of a load or pressure applied during press-fitting operation of the sleeve relative to the housing. The joint portion is free from micro-cracks, which may result in a conduction failure between the lead portion of the heater and the sleeve or lowered operational reliability in performing repeated energization of the heater.

Preferably, a portion of an outside surface of the sleeve and a corresponding portion of the inside surface of the housing, which are located in a radial outward direction of the joint portion, are so configured as to define a space therebetween.

With the space thus provided in addition to the axially offset positional relationship between the joint portion and the press-fit portion, it is possible to prevent a load or pressure from transmitting from the press-fit portion to the joint portion during press-fitting operation.

To provide the space, the portion of the inside surface of the housing, which faces the portion of the outside surface of the sleeve located in the radial outward direction of the joint portion, may be configured to recede in the radial outward direction relative to a portion of the inside surface of the housing located at the press-fit portion. Alternatively, the portion of the outside surface of the sleeve, which is located in the radial outward direction of the joint portion, is configured to recede in a radial inward direction relative to a portion of the outside surface of the sleeve located at the press-fit portion.

In one preferred form, the portion of the outside surface of the sleeve, which is located in the radial outward direction of the joint portion, is configured to form a small-diameter portion having an outside diameter smaller than an outside diameter of the portion of the outside surface of the sleeve located at the press-fit portion. In the case where the joint portion is disposed at a rear end of the sleeve, it is preferable that the small-diameter portion comprises a taper portion having a diameter reducing gradually in a direction from the front end toward the rear end of the sleeve. The sleeve is normally formed by a cold-forging process and, hence, the taper portion can be readily formed during cold-forging operation to produce the sleeve.

The joint portion may be offset relative to the press-fit portion in either a direction toward the end of the housing or a direction toward a second end of the housing, which is opposite to the first-mentioned end of the housing.

Preferably, the press-fit portion and the joint portion are offset in position relative to each other in the axial direction of the housing by an offset distance not less than 0.5 mm.

By thus providing the offset distance, transmission of the press-fitting load or pressure from the press-fit portion to the joint portion is prevented with improved reliability.

In a second aspect of the invention, there is provided a method of producing a glow plug of the structure as defined above, characterized in that the sleeve and the housing are press-fitted with each other by using a jig with the heater held in the sleeve in such a manner that the front end portion of the heater projecting from the front end of the sleeve is held out of contact with the jig to thereby prevent a load from acting on the front end portion of the heater.

By thus keeping the front end portion of the heater out of contact with the jig, a load or pressure applied during press-fitting operation does not act on the front end portion of the heater projecting from the front end of the sleeve. The front heater end portion is thus free from any ruptures.

DETAILED DESCRIPTION OF THE PREFERRED EMBODIMENTS

Figure 1:
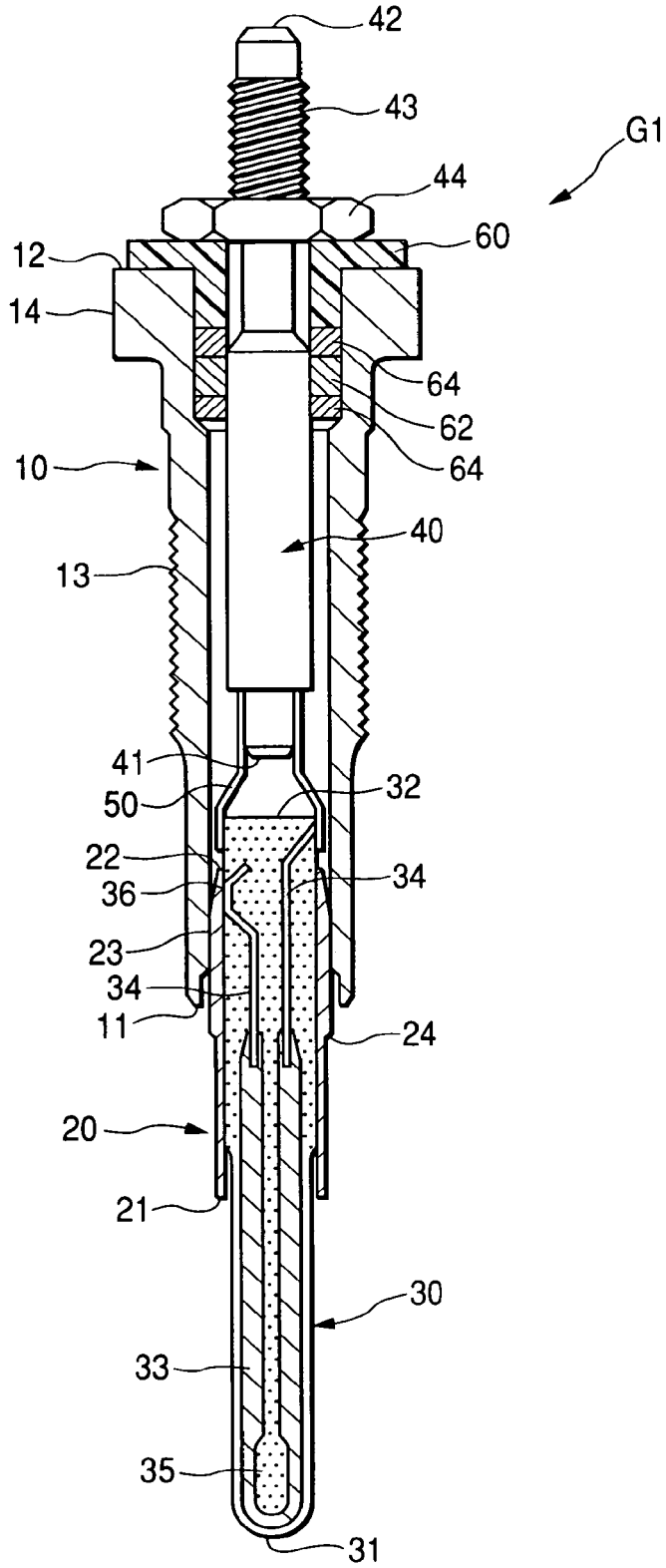
FIG. 1 is a longitudinal cross-sectional view of a glow plug according to a first embodiment of the present invention.

Certain preferred structural embodiments of the present invention will be described in detail herein below, by way of example only, with reference to the accompanying sheets of drawings, in which identical or corresponding parts are denoted by the same reference characters throughout views.

FIG. 1 shows in longitudinal cross-section a glow plug G1 according to a first embodiment of the present invention. In use, the glow plug G1 is mounted in each of plural (four, for example) mounting holes (glow holes) formed in respective engine heads of an automotive direct injection diesel engine for promoting ignition and burning of fuel at the start-up of the engine.

The glow plug G1 includes a housing 10 comprised of a cylindrical member mountable to the engine and formed from an electrically conductive material such as an iron-based material. The cylindrical housing 10 has an externally threaded portion 13 formed on an outer peripheral surface thereof at a position located between a front end 11 (lower end in FIG. 1) and a rear end 12 (upper end in FIG. 1) of the cylindrical housing 10, and a hexagonal head portion 14 formed at the rear end 12 of the cylindrical housing 10.

Though not shown, the glow plug G1 is inserted in a glow hole in the engine head with the front end 11 of the housing 10 directed forward in a direction toward a combustion chamber, and the hexagonal head portion 14 is turned about an axis of the cylindrical housing 10 until the externally threaded portion 13 of the housing 10 is firmly secured to an internally threaded portion formed in an inside surface of the glow hole. The glow plug G1 can thus be removably mounted to the engine head.

The housing 10 is produced, for example, by cold forging a carbon steel into a semi-finished housing of cylindrical configuration having inside and outside surfaces finished or cold-forged into final dimensions, followed by thread-cutting to form an externally threaded portion 13 on the outside surface of the semi-finished housing. The threaded portion 13 may have a size not greater than M8 stipulated by JIS (Japanese Industrial Standards).

The housing 10 has an axial hole (not designated) in which a cylindrical sleeve 20 is received. The sleeve 20 is formed from a heat-resistant and corrosion-resistant alloy, such as stainless steel, through a cold forging process.

The sleeve 20 has a front end portion (lower end portion in FIG. 1) projecting from the front end 11 of the housing 11 and a rear end portion (upper end portion in FIG. 1) inserted in the housing 10. More specifically, the rear end portion of the sleeve 20 is press-fitted in the housing 11 so that a portion of the inside surface of the cylindrical housing 10 and a portion of the outside surface of the cylindrical sleeve 20 are secured together through a press-fit connection to thereby hold the sleeve 20 in the housing 10. The press-fit connection between the sleeve 20 and the housing 10 forms a press-fit portion 23.

The cylindrical sleeve 20 has an axial hole (not designated) in which a ceramic heater 30 of rod-like configuration is received. The ceramic heater 30 has a property to generate heat when energized or supplied with electricity.

The ceramic heater 30 has a front end portion (lower end portion in FIG. 1) projecting from a lower end 21 of the sleeve 20 and a rear end portion (upper end portion in FIG. 1) inserted in the sleeve 20. The rear end portion of the heater 30 is firmly secured to the sleeve 20 by brazing, for example, so that the heater 30 is held on the sleeve 20.

The heater 30 is formed by an electrically conductive heat generating portion (heater element) 33 and an insulator 35 of insulating ceramic in which the heater element 33 is buried.

Figure 2:
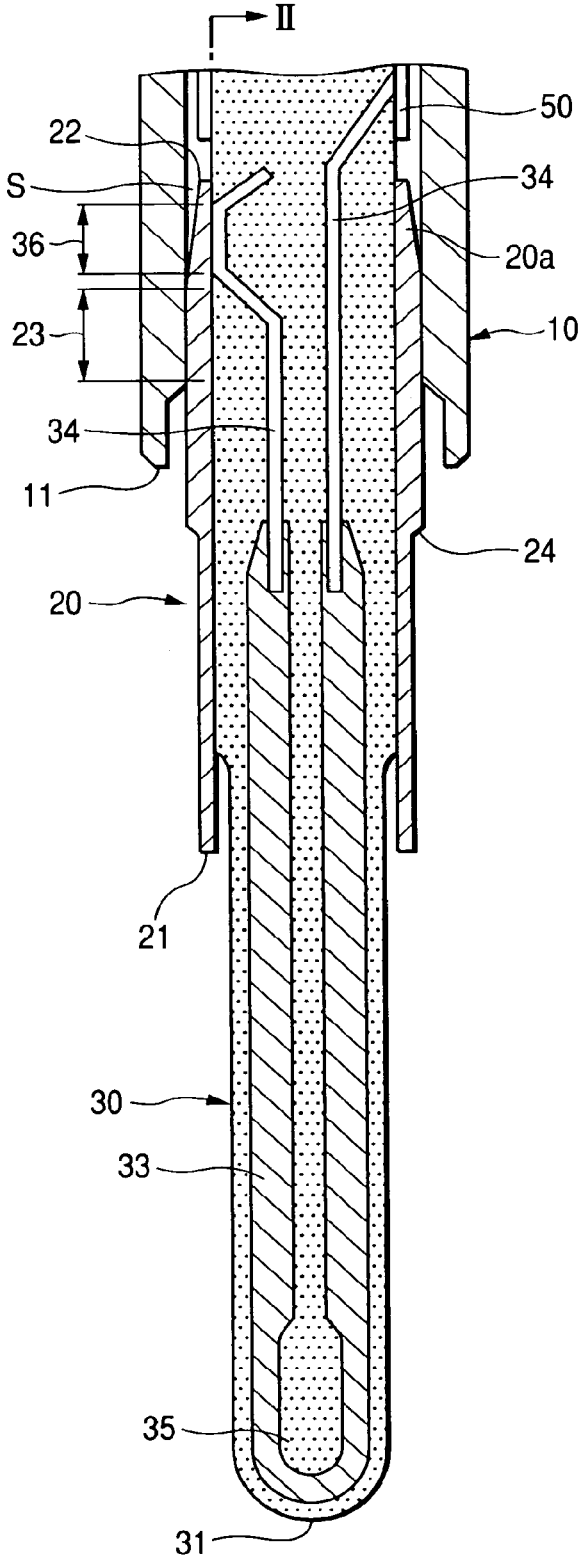
FIG. 2 is an enlarged view of a portion of FIG. 1 showing a ceramic heater and neighboring parts thereof.

Stated more specifically, as shown in FIGS. 1 and 2, the ceramic heater 30 comprises a sintered member including the heater element 33 of generally U-shaped configuration, and a pair of lead wires 34 as a lead portion electrically connected to opposite ends of the U-shaped heater element 33 for supplying the heater element 33 with electricity. The heater element 33 and the pair of lead wires 34 are buried in the ceramic insulator 35.

The heater element 33 is formed from an electrically conductive ceramic containing, for example, silicon nitride and tungsten carbide as ingredients. The lead wires 34 are formed from a metal wire of tungsten, for example. The insulator 35 is formed from an insulating ceramic containing, for example, silicon nitride as an ingredient.

The housing 10 receives in its axial hole (not designated) an internal shaft 40 inserted from the rear end 12 of the housing 10. The internal shaft 40 is formed from carbon steel and shaped by cutting and cold-forging into a desired final shape. The internal shaft 40 has a front end portion 41 (lower end portion in FIG. 1) of small-diameter, and a cap lead 50 formed from a conductive metal such as stainless steel is fitted around the front end portion of the internal shaft 40.

One of the pair of lead wires 34 of the heater 30, which is shown on the right-hand side in FIG. 1, is connected by brazing, for example, to the cap lead 50 at a distal end portion thereof exposed from the insulator 35 at a rear end 32 (upper end in FIG. 1) of the heater 30. Thus, the right lead wire 34 is electrically connected to the internal shaft 40.

The other lead wire 34 (left lead wire in FIG. 1) has a distal end portion exposed to an outer peripheral surface of the insulator 35 located inside the sleeve 20. The exposed end portion of the left lead wire 34 is connected by brazing, for example, to the inside surface of the cylindrical sleeve 20. The left lead wire 34 is grounded through the sleeve 20 to the housing 10.

In the embodiment described above, the distal end portion of the left lead wire 34 that is exposed to the outer peripheral surface of the insulator 35 and a portion of the inside surface of the cylindrical sleeve 20 that corresponds in position to the exposed distal end portion of the left lead wire 34 are mechanically and electrically connected together and jointly form a joint portion 36.

As clearly shown in FIG. 2, the press-fit portion 23 where the sleeve 20 is secured by press-fitting to the housing 10 and the joint portion 36 between the sleeve 20 and the heater 30 are offset in position relative to each other along an axial direction of the housing 10. More properly, the press-fit portion 23 and the joint portion 36 are arranged not to overlap with each other when viewed in a direction perpendicular to the axis of the housing 10 but to be in a spaced-apart relation in the axial direction of the housing 10.

Figure 3:
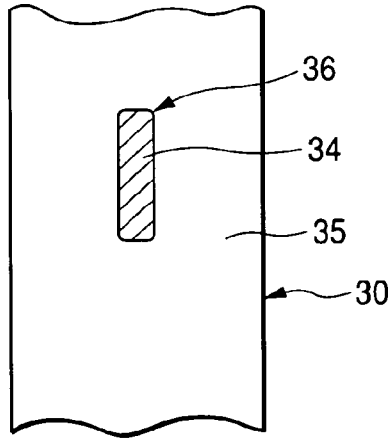
FIG. 3 is an enlarged view of a joint portion between the heater and a sleeve when viewed in a direction of arrow II of FIG. 2.

For the heater 30, the joint portion 36 includes all the area of the left lead wire 34 which is exposed from the heater 30 (more specifically the insulator 35), as indicated by hatching for clarity in FIG. 3, for the purpose of conduction with the sleeve 20.

Similarly, the press-fit portion 23 includes respective portions of the housing 10 and the sleeve 20 that are in direct contact with each other with a stress induced therein due to action of press-fit load or pressure, as shown in FIG. 2.

The outside surface of the sleeve 20 is reduced in diameter at a portion 20*a* thereof, which corresponds in position to the joint portion 36 in a radial direction of the sleeve 20. The portion 20*a* forms a small-diameter portion having an average diameter smaller than an outside diameter of the sleeve 20 measured at the press-fit portion 23.

By thus forming the small-diameter portion 20*a*, that portion of the outside surface of the sleeve 20 which is located in a radial outward direction of the joint portion 36 is configured to recede in a radial inward direction of the sleeve 20 with respect to a portion of the outside surface of the sleeve 20 located at the press-fit portion 36.

In the arrangement shown in FIG. 2, the joint portion 36 is offset toward the rear end 12 of the housing 10 relative to the press-fit portion 23 in the axial direction of the housing 10. Furthermore, the joint portion 36 is disposed at a rear end 22 (upper end in FIG. 2) of the sleeve 20.

The afore-said small-diameter portion 20*a* of the sleeve 20, which corresponds in position to the joint portion 36 located at the rear end of the sleeve 20, comprises a taper portion having a diameter reducing gradually in a direction from the front end 21 toward the rear end 22 of the sleeve 20.

As thus far explained, the glow plug G1 (FIG. 1) according to the first embodiment of the present invention has structural features such that the press-fit portion 23 and the joint portion 36 are offset in position relative to each other along the axial direction of the housing 10 (i.e., the press-fit portion 23 and the joint portion 36 are arranged not to overlap with each other when viewed in a direction perpendicular to the axis of the cylindrical housing 10 but to be in a spaced-apart relation in the axial direction of the housing 10), and a portion of the outside surface of the sleeve 20 and a corresponding portion of the inside surface of the housing 10, which are located in radial outward direction of the joint portion 36, are so configured as to define a space S (FIG. 2) therebetween.

As shown in FIG. 1, the internal shaft 40 has a rear end portion 42 (upper end portion in FIG. 1) projecting outward from the rear end 12 of the housing 10. The projecting rear end portion 42 is externally threaded as at 43 so that an external wiring member (not shown) electrically connected to a power source (not shown) is threadedly engaged with the externally threaded rear end portion 42 of the internal shaft 40.

Between the rear end portion 42 of the internal shaft 40 and the housing 10, there are disposed electrically insulating members including a flanged insulating bushing 60, an annular fused glass for holding, securing and centering the internal shaft 40, and ring-shaped insulators 64, 64. The fused glass 62 and the insulators 64 disposed on opposite sides of the fused glass 62 are secured in position by a nut 44 firmly secured to the threaded rear end portion 42 with the insulating bushing 60 disposed between the nut 44 and the insulator 64.

The glow plug G1 of the foregoing construction is produced in a manner as described below.

A heater 30 is formed by sintering using a hot pres, followed by rounding of one end 31 thereof using a grinder, as described in greater detail in Japanese Patent Laid-open Publication (JP-A) No. 2000-130755.

Then, the heater 30 is inserted in a sleeve 20 with a cap lead 50 fitted around a rear end portion of the heater 30 so that the cap lead 50 and one lead wire 34 (right lead wire in FIG. 1) are in contact with each other, and an exposed end portion of the other lead wire 34 (left lead wire in FIG. 1) and the inside surface of the sleeve 20 are in contact with each other. While keeping this condition, the cap lead 50 and the right lead wire 34 and the exposed end portion of the left lead wire 34 and the inside surface of the sleeve 20 are firmly connected together by brazing. Subsequently, the cap lead 50 is secured by clenching, for example, to a lower end portion of an internal shaft 40. Thus, the heater 30, internal shaft 40, sleeve 20 and cap lead 50 are integrally connected together to form a single integrated member.

The integrated member is inserted in a housing 10, and the housing 10 and the sleeve 20 are secured together by press fitting. Assembly of the integrated member and the housing 10 using a press-fitting operation will be described below with reference to FIGS. 4A through 4D and FIG. 5.

Figure 4D:
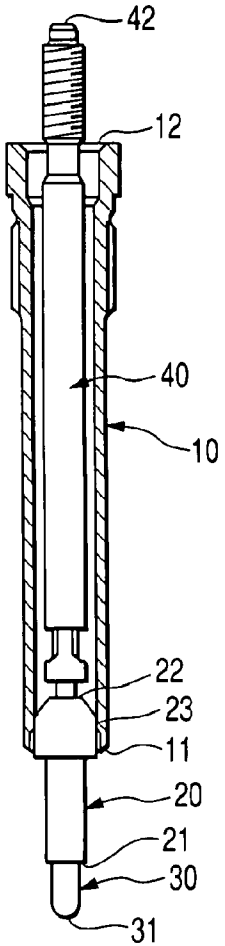
FIGS. 4A to 4D are schematic views showing a sequence of operations achieved when the sleeve is secured by press-fitting to a housing of the glow plug.
Figure 4C:
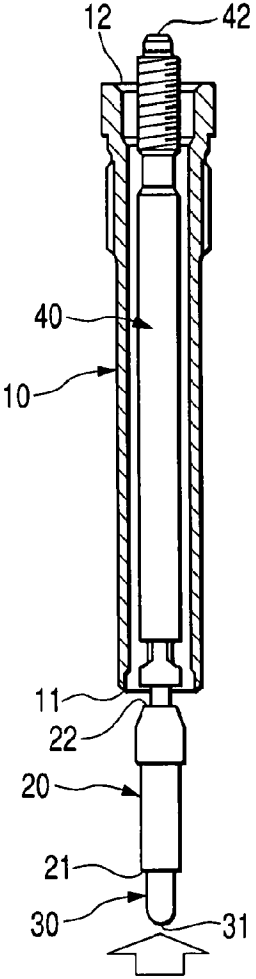
Figure 4B:
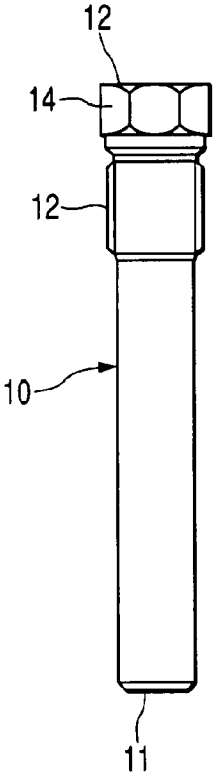
Figure 4A:
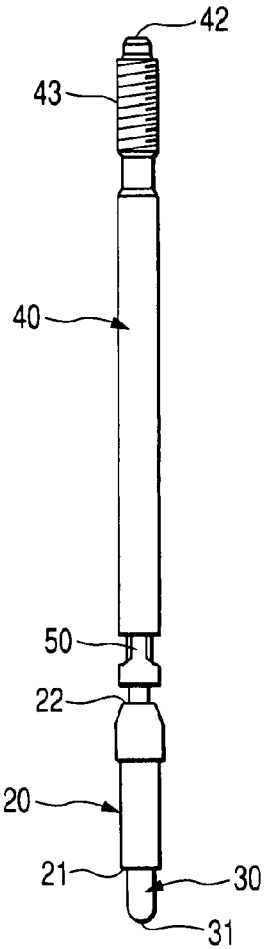
Figure 5:
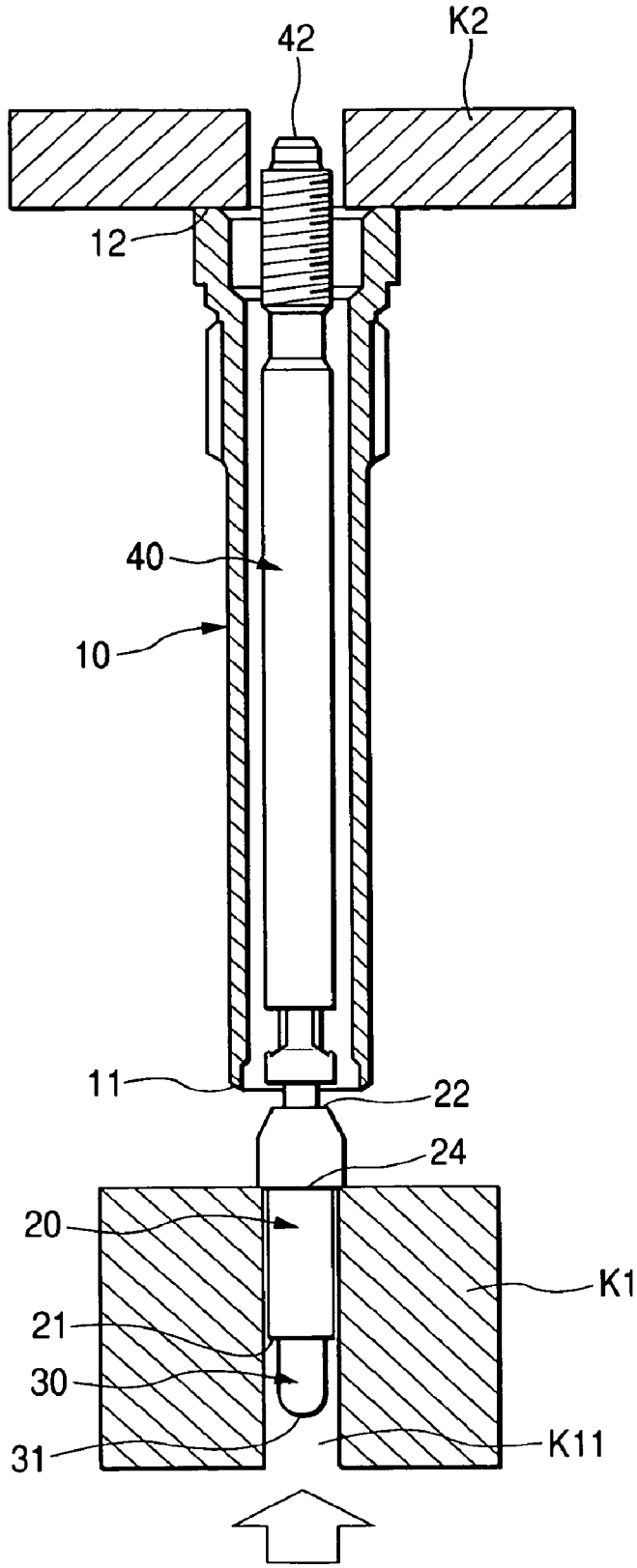
FIG. 5 is a schematic view with parts shown in cross-section, showing the manner in which the sleeve and the housing are press-fitted with each other using jigs.

FIGS. 4A to 4D schematically show a sequence of operations achieved when the integrated member and the housing 10 are assembled together, and FIG. 5 shows a manner of assembly in which jigs K1 and K2 are used.

At first, an integrated member formed by the heater 30, internal shaft 40, sleeve 20 and cap lead 50, as shown in FIG. 5A and a housing 10 shown in FIG. 5B are prepared. Then, a rear end (upper end) 42 of the internal shaft 40 is inserted into the housing 10 from a front end (lower end) 11 thereof, as indicated by a profiled arrow shown in FIG. 4C. Subsequently, the sleeve 20 is press-fitted into the housing 10 so that a press-fit portion 23 is formed between the sleeve 20 and the housing 10, as shown in FIG. 4D.

In practice, the press-fitting process is carried out with lubricating oil existing at the press-fit portion 23 between the sleeve 20 and the housing 10. In the press-fitting process, the sleeve 20 is forcibly inserted in a direction from the front end (lower end) 11 toward a rear end (upper end) 12 of the housing 10. This press-fitting direction indicated by the profiled arrow shown in FIG. 4C is determined so that the integrated member cannot be removed even when subjected to a combustion pressure.

The press-fitting process is achieved by using two jigs K1 and K2, as shown in FIG. 5. The first jig K1 is used to support thereon the sleeve 20 of the integrated member, and the second jig K2 is used to retain the rear end (upper end) 12 of the housing 10. In this instance, a front portion (lower portion) of the sleeve 20 and a front portion (lower portion) of the heater 30 projecting from the front end 21 of the sleeve 20 are received in a hole K11 formed in the jig K1. The front end portion of the sleeve 20 is smaller in outside diameter than a rear end portion (upper end portion) and separated from the rear end portion by an intermediate step 24 where an upper surface of the jig K1 is in contact with the sleeve 20 for supporting the sleeve 20.

While keeping this condition, the first jig K1 is forced to move toward the K2 so that the sleeve 20 is press-fitted into the housing 10 from the front end 12 thereof. During that time, the front end portion of the heater 30 projecting from the front end 21 of the sleeve 20 is held out of contact with a peripheral surface of the hole K11. This means that the projecting front end portion of the heater 30 is held out of contact with the jig K1 and hence is completely free from the effect of a load or pressure applied to the jig K1.

When the press-fitting process is completed, the sleeve 20 and the housing 10 are firmly secured together at the press-fit portion 23, as shown in FIG. 4D. As a result, the integrated member and the housing 10 are assembled together. An assembly composed of the integrated member and the housing 10 is then subjected to a next subsequent process in which, as shown in FIG. 1, a flanged insulating bushing 60, an annular fused glass 62 and ring-shaped insulators 64 are fitted around the internal shaft 40, and a nut 44 is tightly fastened to the threaded rear end portion 42 of the internal shaft 40. The fused glass 62 is charged in the form of a fusible glass powder held between the insulators 64 and fused with heat. A glow plug G1 of the construction shown in FIG. 1 is thus produced.

As previously described, the glow plug G1 is mounted in a glow hole of an engine head through a threaded connection formed between the externally heated portion 13 of the glow plug G1 and an internally threaded portion of the glow hole. When the glow plug G1 is mounted in the engine head, the front end 31 of the heater 30 is exposed into a combustion chamber of the engine.

After the glow plug G1 is mounted on the engine head, an external wiring member, such as a terminal, electrically connected to a power source is clamped to the externally threaded rear end portion 42 of the internal shaft 40 by means of a nut (not shown) firmly secured to the threaded rear end portion 42. With this arrangement, the heater 30 can now be energized or supplied with electicity from the power source via the external wiring member and the internal shaft 40, with the housing 10 and the engine head being a ground or earth side.

In use of the glow plug G1, the heater 30 is energized whereupon the heater element 33 generates heat, which will ignite fuel inside the combustion chamber. By using the glow plug G1, it is possible to promote ignition and burning of the fuel at the start-up of the engine.

In the first embodiment described above, the glow plug G1 includes a cylindrical housing 10, a cylindrical sleeve 10 having a front end portion projecting from an end 11 of the housing 10 and a rear end portion secured by press-fitting to the housing 10, and a ceramic heater 30 of rod-like configuration held in the sleeve 20 with a front end portion thereof projecting from a front end 21 of the sleeve 20 and a rear end portion thereof inserted in the sleeve 20. The ceramic heater 30 can generate heat when energized or supplied with electricity and includes an electrically conductive heat generating portion (heater element) 33 buried in an insulator 35 of insulating ceramic, and a lead portion 34 electrically connected to the heater element 33 and having an end portion exposed to an outer peripheral surface of the heater 30 inside the sleeve 20.

The exposed end portion of the lead portion 34 and an inside surface of the sleeve 30 are electrically connected together to form a joint portion 36. The sleeve 20 has a press-fit portion 23 where the sleeve 20 is secured by press-fitting to the housing 10.

The glow plug G1 has a structural feature that the press-fit portion 23 between the sleeve 20 and the housing 10 and the joint portion 36 between the heater 30 and the sleeve 20 are offset in position relative to each other along an axial direction of the cylindrical housing 10. Stated in other words, the press-fit portion 23 and the joint portion 36 are arranged not to overlap with each other when viewed in a direction perpendicular to the axis of the cylindrical housing 10 but to be in a spaced-apart relation in the axial direction of the housing 10. A further structural feature of the glow plug G1 is that a portion of the outside surface of the sleeve 20 and a corresponding portion of the inside surface of the housing 10, which are located in a radial outward direction of the joint portion 36, are so configured as to define a space S therebetween.

By virtue of a combination of the axially offset arrangement (i.e., radially non-overlapping and axially spaced-apart arrangement) of the press-fit portion 23 and the joint portion 36 and the space S defined between the sleeve 20 and the housing 10 at a position located in a radial outward direction of the joint portion 36, the joint portion 36 does not form a part of the press-fit portion 23 but is structurally separated from the press-fit portion 23. Thus, the joint portion 36 is free from the influence of load or pressure acting on the press-fit portion 23 when the sleeve 20 and the housing 10 are secured together by press-fitting.

In the glow plug G1 according to the first embodiment described above, the sleeve 20 is secured by press-fitting to the housing 10 with the ceramic heater 30 received in the sleeve 20, however, owing to the structural features discussed above, press-fitting loads or pressure cannot act on the joint portion 36 where the heater 30 and the sleeve 20 are electrically connected together. The joint portion 36 is, therefore, free from micro-cracks, which may result in a conduction failure between the lead portion 34 and the sleeve 20 or limited reliability in operation to perform repeated energization of the heater element 33.

Furthermore, in the first embodiment shown in FIGS. 1-5, the joint portion 36 is located near the rear end 22 of the sleeve 20, and a portion of the sleeve 20 corresponding in position to the joint portion 36 in a radial direction of the sleeve 20 is reduced in diameter as at 20*a*. The small-diameter portion 20*a* comprises a taper portion having a diameter reducing gradually in a direction from the front end 21 toward the rear end of the sleeve 20.

The sleeve 20 is normally produced by coil-forging process, as previously described. The taper portion 20*a* of the sleeve 20 can be readily formed during cold-forging operation achieved to produce the sleeve 20.

Load or pressure employed to press-fit the sleeve 20 to the housing 10 is in a range of 2 kN to 10 kN. This range is determined after consideration based on an experiment made by the present inventor.

Figure 15:
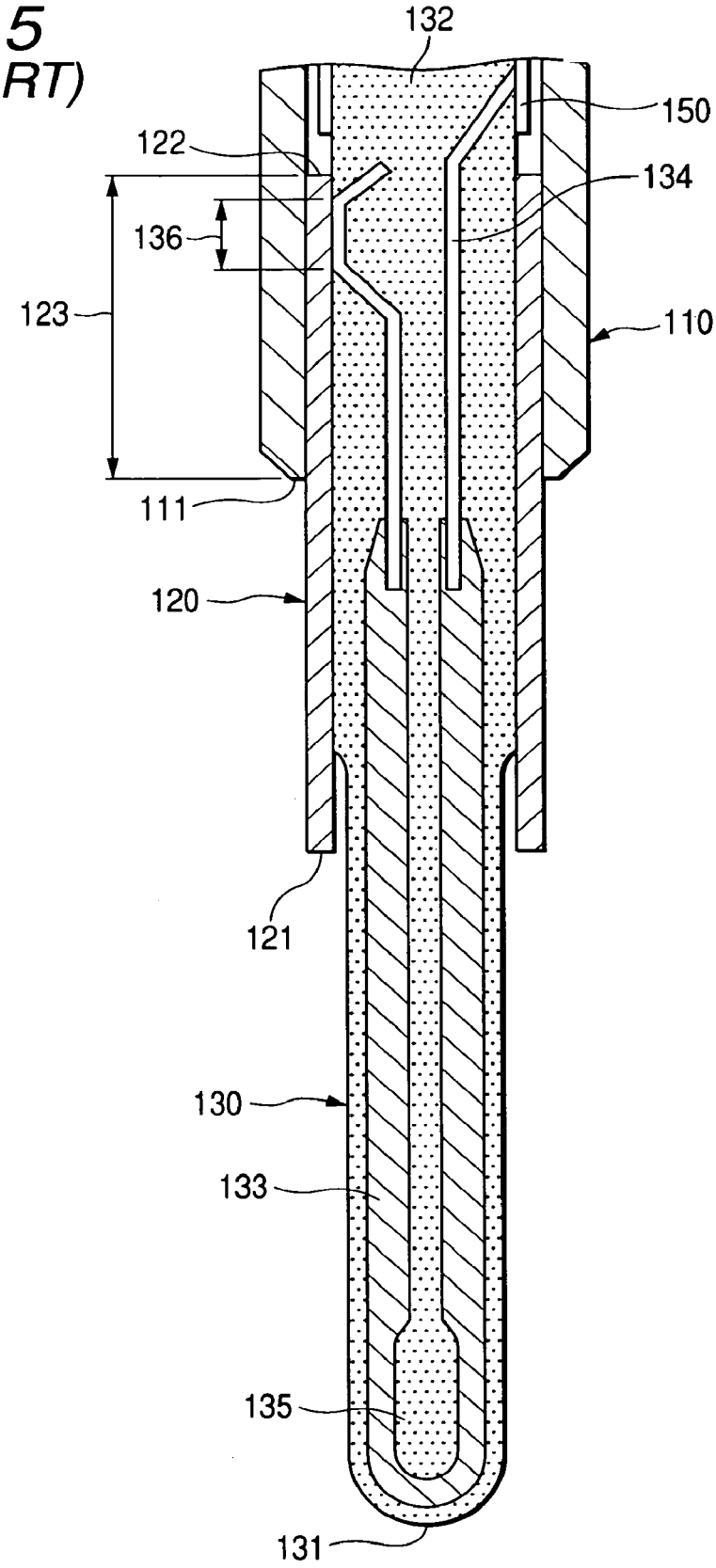
FIG. 15 (PRIOR ART)
FIG. 15 is a longitudinal cross-sectional view showing a main portion of a conventional glow plug.

In the experiment, glow plugs G1 each including a sleeve 20 having a taper portion 20*a*, such as shown in FIG. 2, and glow plugs each including a sleeve 120 of a uniform diameter free from a taper portion, such as shown in FIG. 15, are prepared as inventive examples and comparative examples, respectively. In the glow plugs of the comparative examples, a joint portion 136 and a press-fit portion 23 overlap with each other when viewed in a direction perpendicular to an axis of the housing 110.

In preparing the glow plugs of both the inventive and comparative examples, press-fitting load or pressure is changed in a range from 1 kN to 12 kN. The glow plugs thus prepared through press-fitting operation with different press-fitting loads or pressures are subjected to a reliability test in which vibrations occurring during actual traveling of a vehicle are applied to the glow plugs for checking the occurrence of cracks in the joint portion 36, 136.

Results of the reliability test are shown in Table 1 below. In Table 1, the term "presence" in a column entitled "Sleeve Taper Portion" represents the glow plugs of the inventive examples, while the term "absence" in the same column represents the glow plugs of the comparative examples.

TABLE 1

| Press-fitting Load | Sleeve Taper Portion | Test Results | Evaluation |
|---|---|---|---|
| 1 kN | Absence | No cracks found in joint portion. | X |
| | Presence | Heater is removed during test. | |
| 2 kN | Absence | Cracks found in joint portion. | X |
| | Presence | No cracks found in joint portion. | ○ |
| 4 kN | Absence | Crack found in joint portion. | X |
| | Presence | No cracks found in joint portion. | ○ |
| 6 kN | Absence | Crack found in joint portion. | X |
| | Presence | No cracks found in joint portion. | ○ |
| 8 kN | Absence | Crack found in joint portion. | X |
| | Presence | No cracks found in joint portion. | ○ |
| 10 kN | Absence | Crack found in joint portion. | X |
| | Presence | No cracks found in joint portion. | ○ |
| 12 kN | Absence | Crack found in joint portion and housing. | X |
| | Presence | No cracks found in joint portion. Cracks found in housing. | Δ |

It is evident from the results shown in Table 1 that with respect to the press-fitting load varying within a range from 2 kN to 10 kN, the glow plugs of the comparative examples encounter cracks occurred in the joint portions 136 while the glow plugs of the inventive examples free from cracks occurred in the joint portions 36.

When the press-fitting load is 1 kN, both the glow plugs of inventive examples and the glow plugs of comparative examples do not encounter the occurrence of cracks in the respective joint portions. This is because the press-fitting load is excessively low. Such excessively low press-fitting load, however, causes removal of the heater (i.e., the integrated member described above) from the housing 10 during the reliability test.

On the other hand, when the press-fitting load is 12 kN, both the glow plugs of inventive examples and the glow plugs of comparative examples encounter the occurrence of cracks in the housings. This is because the press-fitting load is excessively large. It will be appreciated from the foregoing discussion that though the press-fitting load is preferably in a range of 2 kN to 10 kN.

According to the method of producing the glow plugs according to the invention, the sleeve 20 is press-fitted in the housing 10 with the heater 30 held in the sleeve 20 while the front end portion of the heater 30 projecting from the front end 21 of the sleeve 20 is kept out of contact with the jig K1. The projecting heater end portion is thus free from the effect of the press-fitting load during press-fitting operation, which may otherwise cause cracking of the projecting heater end portion.

Figure 6:
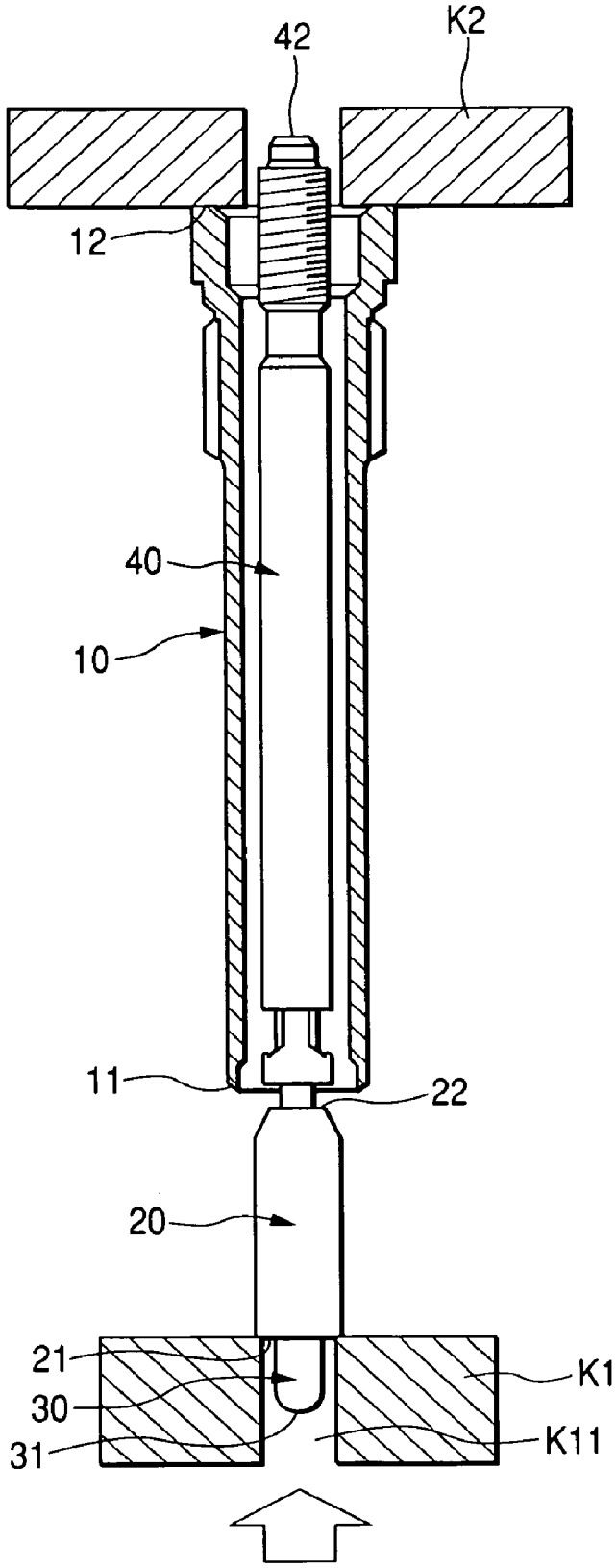
FIG. 6 is a view similar to FIG. 5, but showing a press-fitting process in which a different sleeve is used.
Figure 7:
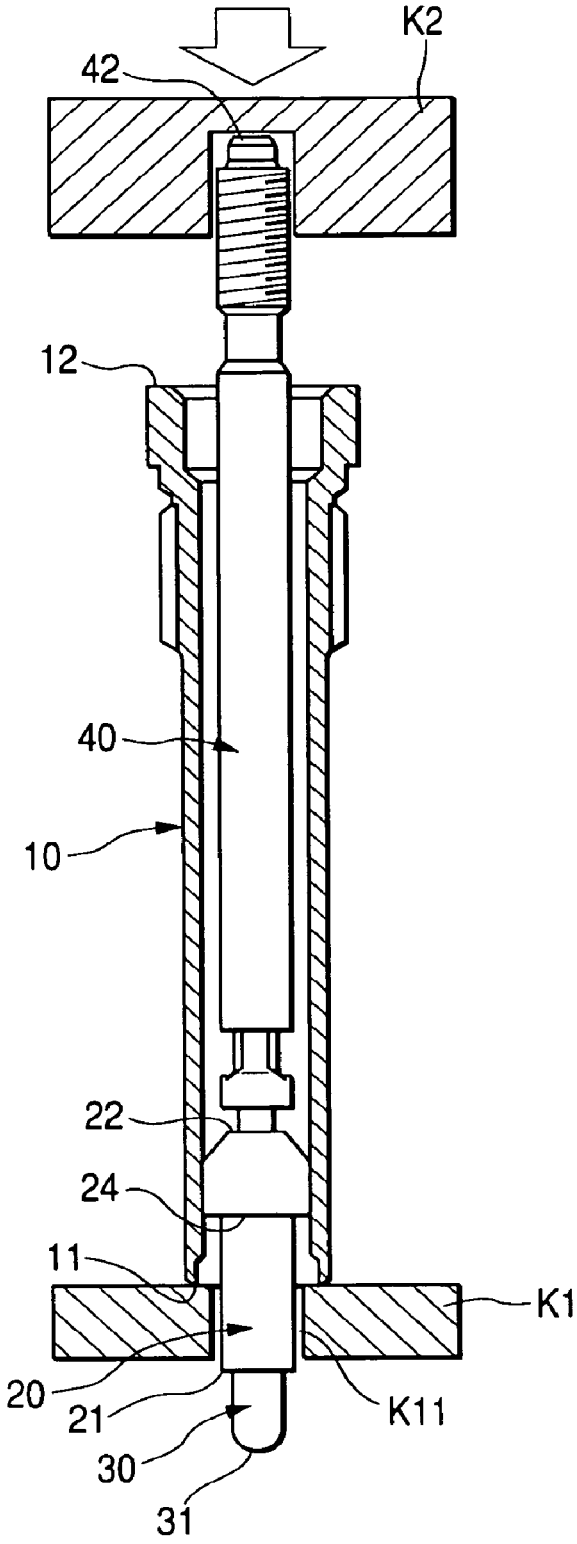
FIG. 7 is a view similar to FIG. 5, but showing a press-fit process in which a press-fitting load is applied in a direction opposite to the direction employed in the process shown in FIG. 5.

The press-fitting process in which the jigs K1 and K2 are used as shown in FIG. 5 may be achieved in different manners as shown in FIGS. 6 and 7. In the process shown in FIG. 5, the sleeve 20 is supported by the jig K1 at the step 24 formed in an intermediate portion of the sleeve 20. In a press-fitting process shown in FIG. 6, the sleeve 20 does not have a step at an intermediate portion thereof and hence is supported by the jig K1 at a front end 21 thereof.

In the press-fitting processes shown in FIGS. 5 and 6, the sleeve 20 is forcibly inserted or press-fitted in the housing 10 in a direction from the front end 11 toward the rear end 12 of the housing 10 as indicated by the profiled arrow. The press-fitting direction of the sleeve 20 relative to the housing 10 may be in a direction from the rear end 12 toward the front end 11 of the housing 10 as indicated by the profiled arrow shown in FIG. 7.

In the process shown in FIG. 7, the housing 11 is supported by a first jig at the front end 11 thereof (lower end in FIG. 7), and the rear end 42 of the internal shaft 40 is held by a second jig K2. The second jig K2 is moved toward the first jig K1 to thereby press-fit the housing 10 over the sleeve 20 in a direction from the rear end 11 toward the front end 11 of the housing 11, as indicated by the profiled arrow shown in FIG. 7.

In the processes shown in FIGS. 6 and 7, the sleeve 20 and the housing 10 are press-fitted with each other while a front end portion of the heater 30 projecting from a front end 21 of the sleeve 20 is kept out of contact with the jig K1. With this arrangement, the projecting heater end portion is kept free from the effect of a load or pressure applied during press-fitting operation of the sleeve 20 relative to the housing 10.

Figure 8A:
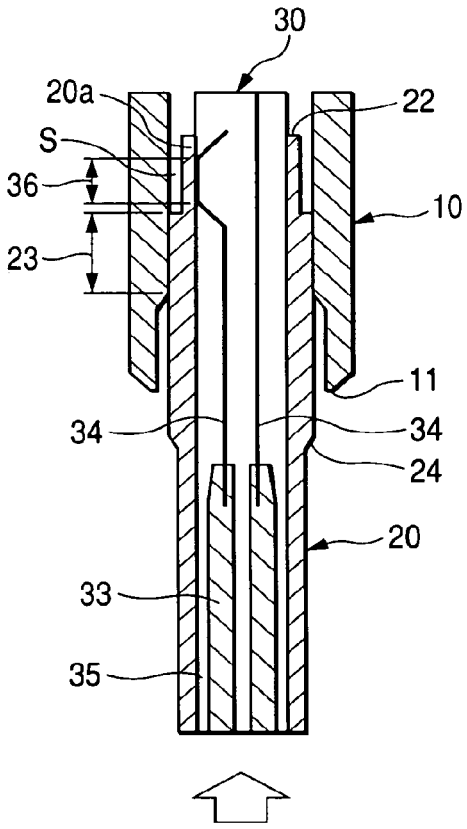
FIG. 8A is a longitudinal cross-sectional view showing a main portion of a glow plug according to a second embodiment of the invention.
Figure 8B:
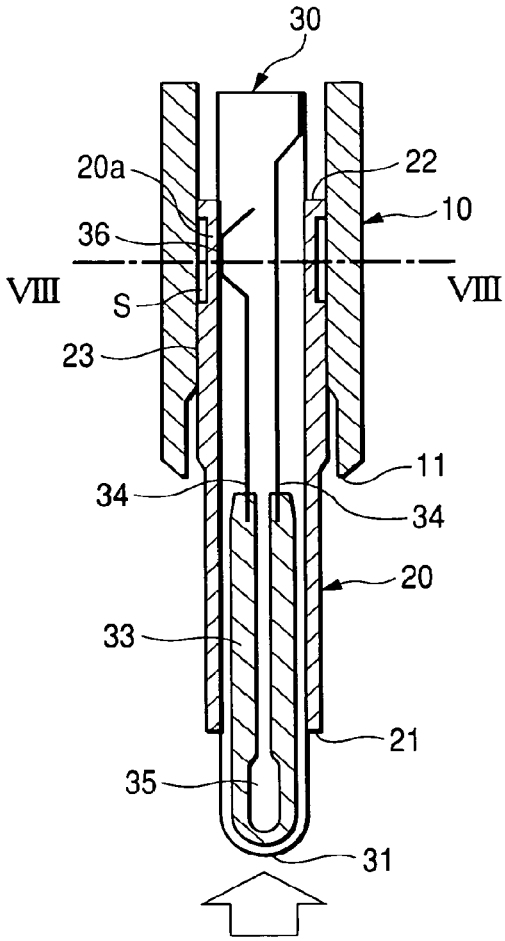
FIG. 8B is a view similar to FIG. 8A, but showing a modified form of the glow plug according to the second embodiment of the invention.
Figure 8C:
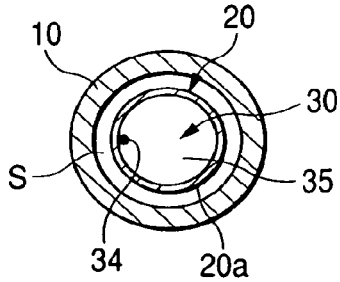
FIG. 8C is a cross-sectional view taken along line VIII-VIII of FIG. 8B.

FIG. 8A and FIGS. 8B and 8C show two preferred forms of the blow plug according to a second embodiment of the present invention, which differs from the blow plug of the first embodiment in that a small-diameter portion 20*a* of a sleeve 20 is not tapered as in the first embodiment but has a uniform diameter throughout the length thereof.

More specifically, in one preferred form of the second embodiment shown in FIG. 8A, the small-diameter portion 20*a* of the sleeve 20 corresponds in position to the joint portion 36 in a radial direction of the sleeve 20 and extends in an axial direction of the sleeve 20 until it reaches a rear end 22 of the sleeve 20. The small-diameter portion 20*a* has a uniform diameter throughout the length thereof.

In the other preferred form of the second embodiment shown in FIGS. 8B and 8C, the small-diameter portion 20*a* of the sleeve 20 is formed as a result of formation of a circumferential groove located in a radially outward direction of the joint portion 36. The small-diameter portion 20*a* does not merge with a rear end 22 of the sleeve 20 but is slightly spaced from the rear sleeve end 22.

Figure 9A:
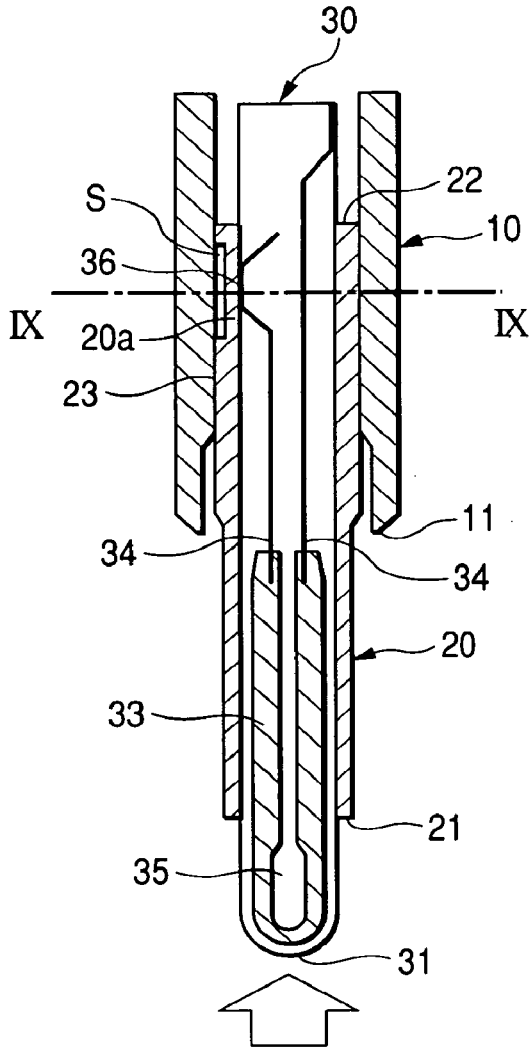
FIG. 9A is a longitudinal cross-sectional view showing another modified form of the glow plug according to the second embodiment of the invention.
Figure 9B:
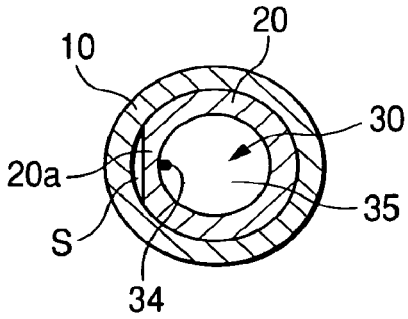
FIG. 9B is a cross-sectional view taken along line IX-IX of FIG. 9A.

The small-diameter portion 20*a* should by no means be limited to those designed to extend over the entire circumference of the sleeve 20 as shown in each of the embodiments discussed above but may includes a modified form, such as shown in FIGS. 9A and 9B. The modified small-diameter portion 20*a* shown in FIGS. 9A and 9B may be formed by cutting away or removing only a limited part of the outside surface of the sleeve which is located in a radial outward direction of the joint portion 36. In this case, the small-diameter portion 20*a* is configured to recede in a radial inward direction relative to a portion of the outside surface of the sleeve 20 located at the press-fit portion 23.

In the various preferred forms of the glow plug according to the second embodiment discussed above, the joint portion 36 and the press-fit portion 23 are in an offset positional relationship with each other along the axial direction of the housing 10, and a portion of the sleeve 20 and a corresponding portion of the housing 10 that are located in a radial outward direction of the joint portion 36 are so configured as to form a space S therebetween. It is, therefore, understood and appreciated that the same advantageous results as described above with reference to the first embodiment can also be attained by the second embodiment.

Figure 10:
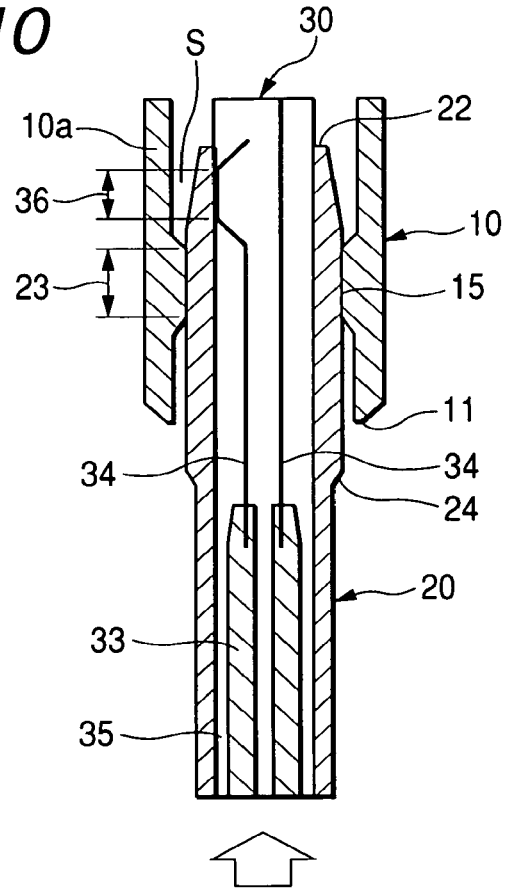
FIG. 10 is a longitudinal cross-sectional view of a main portion of a glow plug according to a third embodiment of the present invention.

FIG. 10 shows in longitudinal cross-section a main portion of a glow plug according to a third embodiment of the present invention. The glow plug in the third embodiment differs from the glow plug in the first embodiment shown in FIG. 1 in that a portion of the inside surface of the housing 10, which faces a portion of the outside surface of the sleeve 120 located in a radial outward direction of the joint portion 36, is configured to recede in the radial outward direction relative to a portion of the inside surface of the housing 10 located at the press-fit portion 23. By thus forming the inside surface portion of the housing 10 into a radially outwardly receding configuration, it is possible to form a space S defined between the portion of inside surface of the housing 10 and a corresponding portion 20*a* of the outside surface of the sleeve 20 that are located in a radial outward direction of the joint portion 36.

More particularly, as shown in FIG. 10, a first longitudinal portion of the housing 10, which forms together with the sleeve 20 a press-fit portion 23, is made thicker so as to form an annular projection 15, so that a second longitudinal portion 10*a* of the housing 10, which is in radial alignment the joint portion 36 and includes the radially inwardly receding inside surface portion of the housing, is made thinner than the first longitudinal portion including the annular projection 15. The first longitudinal portion of the housing 10 forming the press-fit portion 23 has a smaller inside diameter than the thin second longitudinal portion 10*a* radially aligned with the joint portion 36. Since the inside surface portion of the housing 10 that forms the press-fit portion 23 is protruded as the annular projection 15, the annular projection 15 is liable to undergo yielding when the sleeve 20 and the housing 10 are press-fitted with each other. With this yielding, the sleeve 20 and the housing 10 can be firmly secured together with improved reliability.

Figure 11:
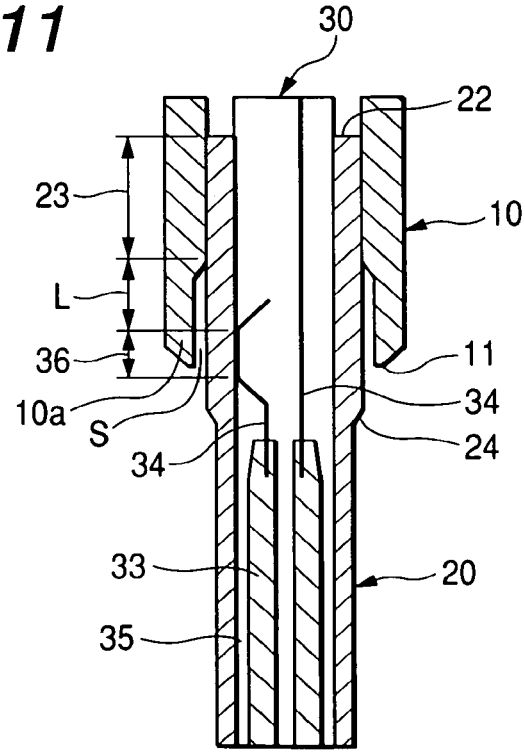
FIG. 11 is a longitudinal cross-sectional view of a main portion of a glow plug according to a fourth embodiment of the present invention.

Referring next to FIG. 11, there is shown in longitudinal cross-section a main portion of a glow plug according to the fourth embodiment of the present invention. The glow plug in this embodiment differs from the glow plug of the first embodiment in that a joint portion 36 between the sleeve 20 and the heater 30 is disposed in opposed relation to a thin portion 10*a* at a front end 11 of the housing 11. The presence of the thin portion 10*a* at the front end 11 of the housing 10 is the same as the first to the third embodiments described above.

To provide the thin portion 10*a*, a portion of the inside surface of the housing 10, which faces a portion of the outside surface of the sleeve 20 located in a radial outward direction of the joint portion 36, is so configured as to recede in a radial outward direction relative to a portion of the inside surface of the housing 10 located at a press-fit portion where the sleeve 20 is press-fit with the housing 10. Thus, the inside surface of the thin portion 10*a* of the housing 10 and a corresponding portion of the outside surface of the sleeve 20, which are located in a radial outward direction of the joint portion 36, define a space S therebetween.

In the fourth embodiment, the joint portion 36 is offset relative to the press-fit portion 23 in a direction toward the front end 11 of the housing 10. The distance L between the press-fit portion 23 and the joint portion 36 that are offset in position relative to each other along the axial direction of the housing 10 is referred to as "offset distance". An investigation on the offset distance L has been made in a manner described below.

Glow plugs of the structure shown in FIG. 1 are prepared under the conditions that the load or pressure applied during press-fitting process is 10 kN, and the offset distance L is selected among from 0.0 mm, 0.3 mm, 0.5 mm, 0.7 mm and 1.0 mm. The number of test samples for each offset distance L is four. The glow plugs thus prepared are subjected to the same reliability test as done in the first embodiment and the presence of cracks in the joint portion 36 is checked. Results of the reliability test are as shown in Table 2 below.

TABLE 2

| Offset Distance (mm) | Test Results | Evaluation |
|---|---|---|
| 0.0 | Cracks found in joint portions of all samples. | X |
| 0.3 | Cracks found in joint portion of one sample. | Δ |
| 0.5 | No cracks found in joint portions of all samples. | ○ |
| 0.7 | No cracks found in joint portions of all samples. | ○ |
| 1.0 | No cracks found in joint portions of all samples. | ○ |

As shown in Table 2, when the offset distance L is 0 mm, i.e., when the press-fit portion 23 and the joint portion 36 are not offset relative to each other along the axial direction of the housing 10, all the test samples encounter generation of cracks in their joint portions 36.

On the other hands, when the press-fit portion 23 and the joint portion 36 are offset in position relative to each other along the axial direction of the housing 10 by the offset distance L, generation of cracks in the joint portion 36 is greatly suppressed for each set of test samples. Especially, when the offset distance is greater than or equal to 0.5 mm, it is possible to completely prevent cracks from occurring at the joint portions 36.

It will be readily appreciated that the offset distance is preferably greater than or equal to 0.5 mm, and more preferably 0.6 mm. By thus providing the offset distance L, it is possible to effectively prevent press-fitting load or pressure from acting on the joint portion 36 where the heater 30 and the sleeve 20 are electrically connected together.

In the embodiments described above, the direction of press-fitting engagement (i.e., press-fitting direction) of the sleeve 20 relative to the housing 10 is, in most cases, from the front end 11 toward the rear end of the housing 10. The press-fitting direction may be from the rear end 12 toward the front end 11 of the housing 10 as shown in the arrangements shown in FIGS. 12A to 12C.

Figure 12C:
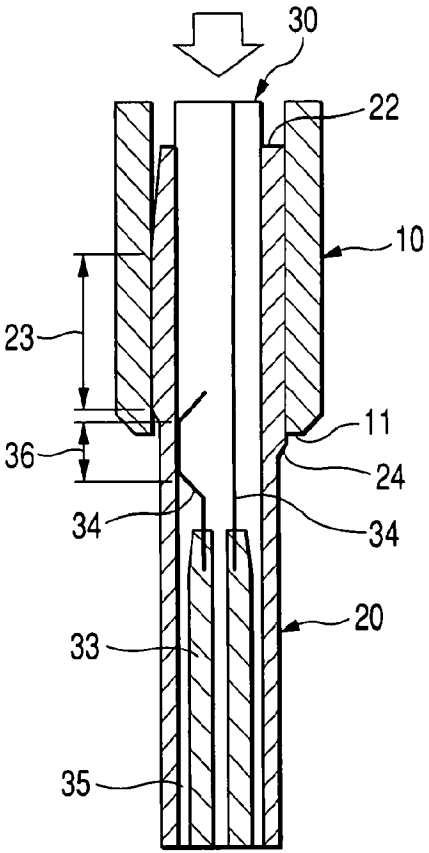
FIG. 12A to 12C are longitudinal cross-sectional views showing various forms of glow plugs each having a sleeve and a housing secured together by press-fitting achieved in a direction from a rear end toward a front end of the housing.
Figure 12B:
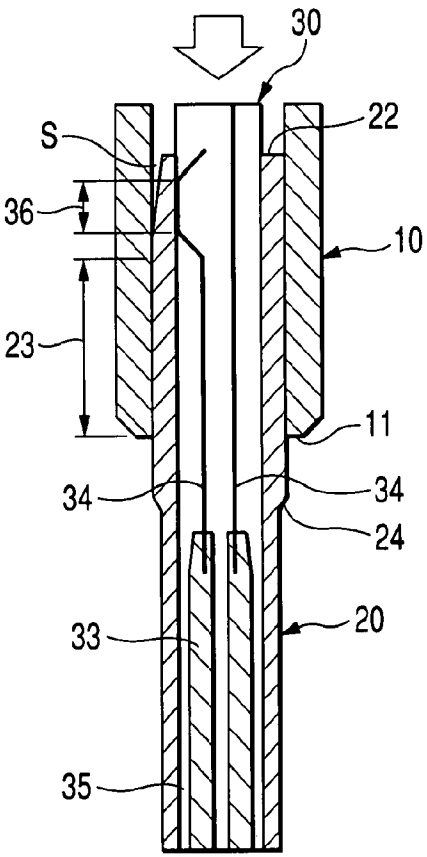
Figure 12A:
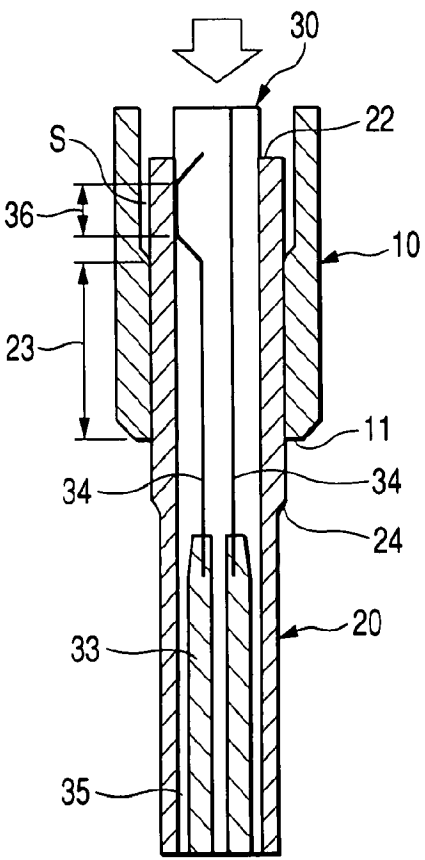

In the arrangements shown in FIGS. 12A to 12C, a press-fit portion between a housing 10 and a sleeve 20 and a joint portion 36 between a heater 30 and the sleeve 20 are offset in position relative to each other along an axial direction of the housing 10. Furthermore, in the arrangements shown in FIGS. 12A and 12B, a portion of an outside surface of the sleeve 20 and a corresponding portion of an inside surface of the housing 10, which are located in a radial outward direction of the joint portion 36, are so configured as to define a space S therebetween. With this arrangement, the joint portion 36 is kept free from the effect of a load or pressure applied during press-fitting operation achieved when the sleeve 20 is forcibly inserted in the housing 10 from the rear end 12 toward the front end 11 of the housing 10 as indicated by the profiled arrow shown in each of FIGS. 12A, 12B and 12C.

Figure 13:
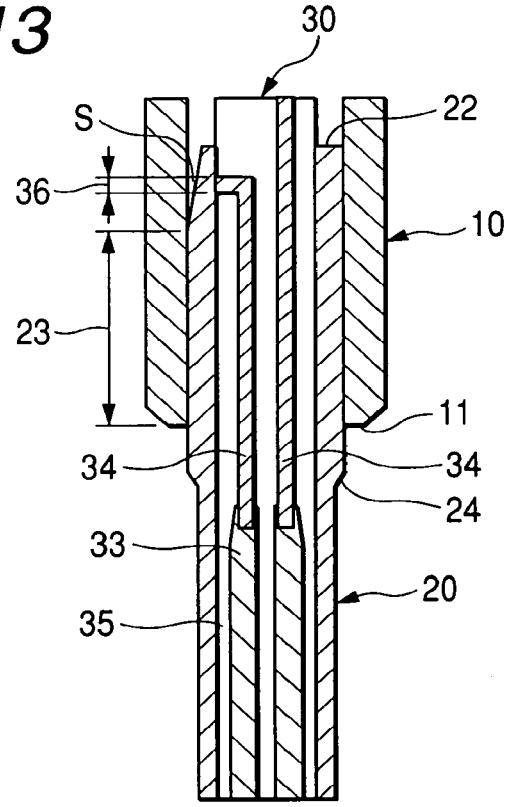
FIG. 13 is a longitudinal cross-sectional view showing a main portion of a glow plug including a lead portion formed from an electrically conductive ceramic.

In the embodiments described above, the lead portion 34 connected to the heat generating portion (heater element) 33 of the heater 30 is formed from a pair of metal wires. The lead portion 33 should by no means be limited to the metal wires but may include one formed from an electrically conductive ceramic material, as shown in FIG. 13. In the arrangement shown in FIG. 13, the heater element 33 is made from an electrically conductive ceramic containing silicon nitride and tungsten carbide as essential gradients, while the lead portion 34 is made from an electrically conductive ceramic containing, as essential ingredients, silicon nitride and tungsten carbide in different proportions than those in the ceramic heater element 33 such that the ceramic lead portion 35 has a lower resistance value than the ceramic heater element 33.

Although the heater elements 33 in the foregoing elements are formed from an electrically conductive ceramic material, a metal wire may be used as a heater element 33. Stated in other words, the heater element 33 may be made from any material provided that such material is electrically conductive and can generate heat when energized or supplied with electricity, so as to perform a necessary function as a glow plug.

Figure 14:
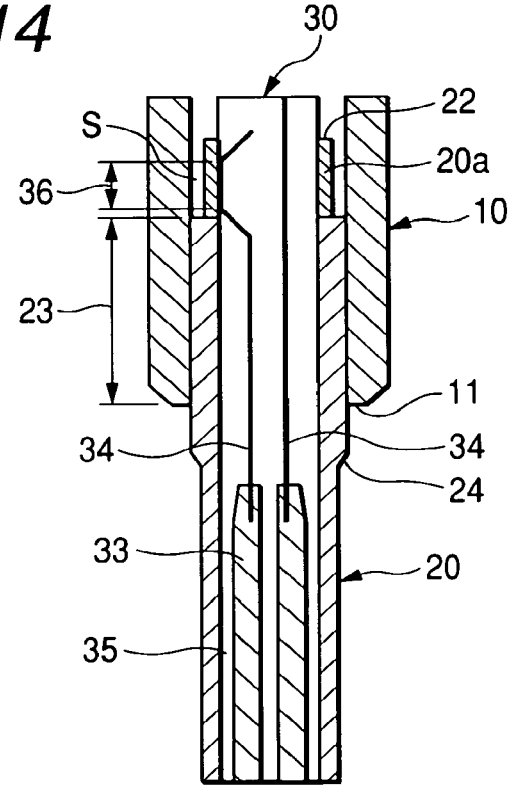
FIG. 14 is a longitudinal cross-sectional view showing a main portion of a glow plug including a sleeve formed from two parts of different materials joined together end to end.

In the embodiments described above, the sleeve 20 has a one-piece structure and is formed from the same material as a whole. However, two or more different materials may be used to form a sleeve. For example, as shown in FIG. 14, a small-diameter portion 20*a* provided at rear end of a sleeve 20 is formed from a metallic material that is different from a metallic material used to form the remaining portion of the sleeve 20. The small-diameter portion 20*a* and the remaining part of the sleeve 20 are produced separately and then they are connected together by welding, for example, to thereby form a sleeve 20.

Furthermore, in the embodiments described above, the press-fit portion 23 and the joint portion 36 are offset in position relative to each other along an axial direction of the housing 10, and a portion of an outside surface of the sleeve 20 and a corresponding portion of an inside surface of the housing 10, which are located in a radial outward direction of the joint portion 36, are configured to define a space S therebetween.

The outside surface portion of the sleeve 20 and the inside surface portion of the housing 10, which are located in the radial outward direction of the joint portion 36, may be in contact with each other. The degree of engagement between these surface portions should be determined such that the surface portions are in light contact with each other but does not form a press-fit connection or joint therebetween. The lightly contacting surface portions of the heater and the sleeve do not constitute a part of the press-fit portion 23.

As thus far explained, glow plugs according to the present invention include a ceramic heater 30 capable of generating heat when energized, and a sleeve 20 secured by press-fitting to a housing 10 with the heater 30 held in the sleeve 20. A lead portion or wire 34 exposed to an outer peripheral surface of the heater 30 is electrically connected to an inside surface of the sleeve 20 to thereby form a joint portion 36. A press-fit portion 23 formed between the sleeve 20 and the housing 10 and the joint portion 36 are offset in position relative to each other along an axial direction of the housing 10. With this arrangement, a load or pressure applied during press-fitting operation to form the press-fit portion 23 between the sleeve 20 and the housing 10 cannot act on the joint portion 36 where the heater 30 and the sleeve 20 are electrically connected together. Thus, the joint portion 36 is free from cracks and can reliably ensure the repeated energization of the heater 30.

It is therefore essential for the invention that the press-fit portion 23 and the joint portion 36 are in offset positional relation to each other along the axial direction of the housing 10. Other features may be changed as appropriate in view of design requirements provided for a desired glow plug.

Obviously, various minor changes and modifications are possible in the light of the above teaching. It is to be understood that within the scope of the appended claims the present invention may be practiced otherwise than as specifically described.

What is claimed is:

1. A glow plug comprising:

a cylindrical housing;

a cylindrical sleeve having a front end portion projecting from an end of the housing and a rear end portion secured by press-fitting to the housing; and a ceramic heater of rod-like configuration held in the sleeve with a front end portion thereof projecting from a front end of the sleeve and a rear end portion thereof inserted in the sleeve, wherein the ceramic heater is capable of generating heat when energized and includes an electrically conductive heat generating portion, an insulator of insulating ceramic in which the heat generating portion is buried, and a lead portion electrically connected to the heat generating portion and having an end portion exposed to an outer peripheral surface of the insulator inside the sleeve, wherein the exposed end portion of the lead portion and an inside surface of the cylindrical sleeve are electrically connected together to form a joint portion, and the sleeve has a press-fit portion where the sleeve is secured by press-fitting to the housing, wherein the press-fit portion and the joint portion are offset in position relative to each other along an axis of the cylindrical housings, wherein a portion of an outside surface of the sleeve and a corresponding portion of the inside surface of the housing, which are located in a radial outward direction of the joint portion, are so configured as to define a space therebetween;

wherein the portion of the outside surface of the sleeve, which is located in the radial outward direction of the joint portion, is configured to recede in a radial inward direction relative to a portion of the outside surface of the sleeve located at the press-fit portion; and wherein the portion of the outside surface of the sleeve, which is located in the radial outward direction of the joint portion, is configured to form a small-diameter portion having an outside diameter smaller than an outside diameter of the portion of the outside surface of the sleeve located at the press-fit portion.

2. The glow plug according to claim 1, the small-diameter portion extends over the entire circumference of the sleeve.

3. The glow plug according to claim 2, wherein the small-diameter portion has a uniform outside diameter throughout the length thereof.

4. The glow plug according to claim 1, wherein the small-diameter portion is formed by removing a material of the sleeve at a limited portion thereof which is located in the radial outward direction of the joint portion.

5. The glow plug according to claim 2, wherein the joint portion is disposed at a rear end of the sleeve, and the portion of the outside surface of the sleeve which is located in the radial outward direction of the joint portion forms, as the small-diameter portion, a taper portion having a diameter reducing gradually in a direction from the front end toward the rear end of the sleeve.

6. The glow plug according to claim 1, wherein the joint portion is offset relative to the press-fit portion in a direction toward the end of the housing.

7. The glow plug according to claim 1, wherein the joint portion is offset relative to the press-fit portion in a direction toward a second end of the housing opposite to the first-mentioned end of the housing.

8. The glow plug according to claim 1, wherein the small-diameter portion of the sleeve is formed from a material, which is different from a material used to form a remaining portion of the sleeve.

9. The glow plug according to claim 1, wherein the press-fit portion and the joint portion are offset in position relative to each other in the axial direction of the housing by an offset distance greater than or equal to 0.5 mm.

* * * * *